United States Patent [19]

Kitagawa et al.

[11] Patent Number: 4,880,717

[45] Date of Patent: Nov. 14, 1989

[54] PHOTOSENSITIVE BODY FOR ELECTROPHOTOGRAPHY WITH PROTECTIVE AND INTERMEDIATE LAYERS

[75] Inventors: Seizo Kitagawa; Mitsuru Narita, both of Matumoto, Japan

[73] Assignee: Fuji Electric Co., Ltd., Japan

[21] Appl. No.: 271,004

[22] Filed: Nov. 14, 1988

Related U.S. Application Data

[63] Continuation-in-part of Ser. No. 192,470, May 10, 1988.

[30] Foreign Application Priority Data

Jun. 6, 1987 [JP] Japan ..... 62-144546
Nov. 16, 1987 [JP] Japan ..... 62-288713

[51] Int. Cl.[4] ..... G03G 5/14
[52] U.S. Cl. ..... 430/58; 430/66; 430/67; 430/85
[58] Field of Search ..... 430/66, 67, 85

[56] References Cited

U.S. PATENT DOCUMENTS 4,710,442 12/1987 Koelling et al. ..... 430/85

*Primary Examiner*—J. David Welsh
*Attorney, Agent, or Firm*—Brumbaugh, Graves, Donohue & Raymond

[57] ABSTRACT

The present invention provides a photosensitive body of Se-based function separation type to be used in electrophotographic equipment which employs long wavelength light for writing. Such a body exhibits outstanding abrasion resistance and heat resistance without sacrificing good electrical properties. This is accomplished by interposing an intermediate layer of As-Se alloy between the surface protective layer and the chargeable layer. The intermediate layer contains As in an increasing concentration gradient across the section of the layer from the chargeable layer to the surface protective layer. This graded As concentration causes the coefficient of thermal expansion to gradually decrease across the intermediate layer section in the direction from the chargeable layer to the surface protective layer. Thus the intermediate layer prevents the surface protective layer from thermal stress and cracking by acting as a transition buffer between the differing properties of the protective layer and chargeable layer.

16 Claims, 1 Drawing Sheet

PHOTOSENSITIVE BODY FOR ELECTROPHOTOGRAPHY WITH PROTECTIVE AND INTERMEDIATE LAYERS

BACKGROUND OF THE INVENTION

This application is a continuation-in-part of U.S. Ser. No. 192,470 filed May 10, 1988.

The present invention relates to a photosensitive body for electrophotography to be used for electrophotographic copiers and printers which use a long wavelength writing light (630 to 800 nm) emitted from a light-emitting diode, liquid crystal, semiconductor laser, or gas laser.

There is well known in the art a photosensitive body for electrophotographic copiers and printers which employs as the writing light a beam of long wavelength light. Such a photosensitive body is of the selenium-based function separation type, which is highly sensitive to long wavelength light. This photosensitive body comprises a chargeable layer which efficiently generates carriers upon exposure to long wavelength light, a charge transfer layer which transfers the generated carriers, and a surface protective layer which protects the chargeable layer from external stress. Usually, the chargeable layer comprises a tellurium-selenium alloy containing 30–50 weight % of tellerium; the charge transfer layer comprises pure selenium or a selenium alloy containing arsenic or tellurium in low concentrations, i.e. 0 to 6 atomic %, with or without halogen doping; and the surface protective layer comprises an As-Se alloy of low As concentration.

In general, the life of a photosensitive body is determined by the mechanical strength of its top layer i.e., surface protective layer. The above-described photosensitive body lacks sufficient mechanical strength because the surface protective layer is made of an As-Se alloy of low As concentration. Many attempts have been made to improve the useful life of the body, such as an increase in the As concentration in the surface protective layer. Additionally, other types of protective layers have been tried, for example, an inorganic or organic insulation layer or a layer made of an insulation material in which electrically conductive powder is dispersed. (See Japanese Patent Publication No. 109065/1986 and Japanese Patent Laid-open Nos. 30846/1982, 79947/1982, 128344/1982, and 117562/1986.) A disadvantage of these surface protective layers is that they exhibit poor heat resistance characteristics or they crack at high temperatures because they possess a coefficient of thermal expansion which is smaller than that of the underlying photosensitive layer.

It is thus an object of the present invention to provide a long-life photosensitive body for electrophotography which is of Se-based function separation type for long wavelength light, yet is free of the above-mentioned disadvantage and further displays good heat resistance without an adverse effect on the electrical properties which are vital to achieve quality image reproduction.

SUMMARY OF THE INVENTION

Accordingly, there is provided an improved photosensitive body for electrophotography of the type having a charge transfer layer and a chargeable layer formed thereon, both of the layers principally comprising selenium, and a surface protective layer having a coefficient of thermal expansion which is smaller than that of the chargeable layer. The body is substantially improved in that it further comprises an intermediate layer of an arsenic-selenium alloy which is interposed between the chargeable layer and the surface protective layer. The arsenic in the intermediate layer displays a graded concentration profile, the concentration increasing across the layer cross-section from the chargeable layer to the surface protective layer.

The invention further resides in a photosensitive body wherein an intermediate layer is interposed between the chargeable layer and the surface protective layer, where the chargeable layer has a high coefficient of thermal expansion compared to that of the surface protective layer. This intermediate layer acts to resist cracking in the protective layer caused by heat stress, or rapid thermal expansion between the changeable layer and protective layer at high temperatures. Since the intermediate layer contains arsenic such that its concentration gradually increases across its cross-section, the coefficient of thermal expansion of the As-Se alloy, and hence of the layer itself, gradually decreases as the As concentration in the alloy increases. This graded intermediate layer acts as a transition buffer to gradually bring together the two adjacent layers, and dampens the possible damage caused by a pulling apart of the layers during thermal expansion.

BRIEF DESCRIPTION OF THE DRAWINGS

FIG. 1(*b*) is a graph showing the distribution of the As concentration and the coefficient of thermal expansion of the intermediate layer of the body of FIG. 1(*a*).

DETAILED DESCRIPTION OF THE INVENTION

Figure 1A:
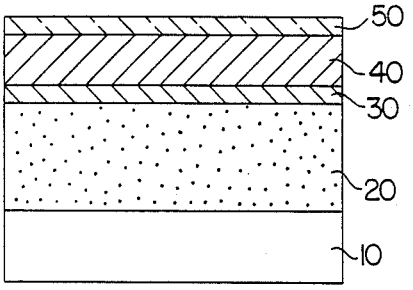
FIG. 1(*a*) is a sectional view of an embodiment of the photosensitive body of the invention.
Figure 1B:
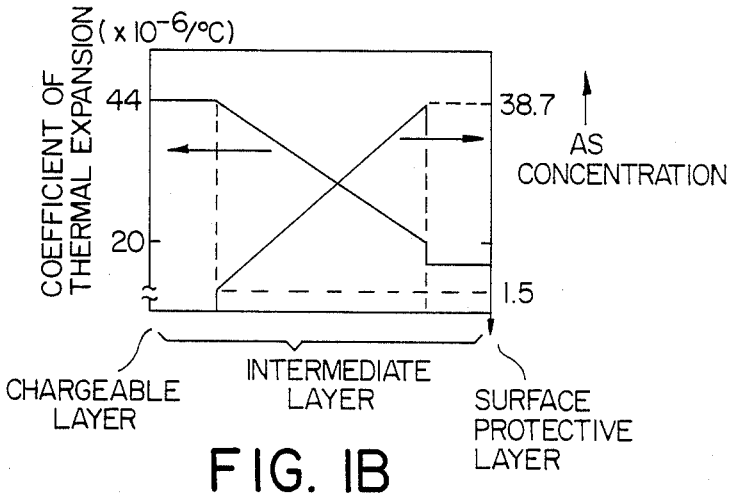

A typical embodiment of the photosensitive body for electrophotography pertaining to the present invention is shown in FIG. 1(*a*) in a sectional view. The conductive substrate 10 is usually a cylinder made of metal such as aluminum or nickel. The charge transfer layer 20 formed on the substrate 10 is made of pure selenium or a selenium alloy containing arsenic or tellurium at low concentrations, i.e. 0 to 6 atomic %, with or without halogen doping. The chargeable layer 30 formed on the charge transfer layer 20 is made of a Te-Se alloy. Its thickness and tellurium concentration are determined by the wavelength of the light employed for image exposure, according to practices known to those in the art. In general, the thickness is in the range of 0.1 to 1 μm and the tellurium concentration is in the range of 30 to 50 weight %. The intermediate layer 40 is made of an As-Se alloy. It contains arsenic in a graded concentration profile, which increases from 1.5 to 38.7 weight % across the layer cross-section, so that the coefficient of thermal expansion of the layer displays a corresponding decreasing graded profile, as shown in FIG. 1(*b*). The layer thickness should preferably be 1 to 5 μm. The As concentration in that part of the intermediate layer 40 which is adjacent to the chargeable layer should preferably be 1.5 weight %, so that the coefficient of thermal expansion at that part is substantially equal to that of the chargeable layer. This concentration also acts to suppress the injection of electrons from the chargeable layer into the surface protective layer 50, which causes dark decay and charge decay. The As concentration in that part of the intermediate layer 40 which is adjacent to the surface protective layer 50 should preferably be 38.7 weight %. The reason being that at this concentration the As-Se alloy exists in its most stable form, $As_2Se_3$, and has the lowest coefficient of thermal expansion. The concentration of As in the intermediate layer 40 should gradually increase along its cross-section from a low value at the point adjacent the chargeable layer 30 to a high value at the point adjacent the protective layer 50. The intermediate layer 40 should preferably have a thickness of 1 to 5 μm. With an excessively small thickness, the intermediate layer 40 is unable to completely suppress the thermal expansion of the underlying chargeable layer. With an excessively large thickness, the intermediate layer 40 absorbs light and decreases the amount of incident light reaching the chargeable layer 30, which leads to a decrease of sensitivity. The surface protective layer 50 may be of a selenium alloy such as $As_2Se_3$, or of a transparent insulation material such as a metal oxide ($Al_2O_3$, ZnO, $SiO_2$, etc.) or plastic (nylon, polyurethane, phenolic resin, acrylic resin, polycarbonate, etc.) The thickness of the surface protective layer should be determined in consideration of the decrease in sensitivity and the rise of exposure potential. It should preferably be approximately 5 μm for $As_2Se_3$, 2 μm for metal oxides, and 3 μm or less for plastics.

EXAMPLE 1

Figure 2:
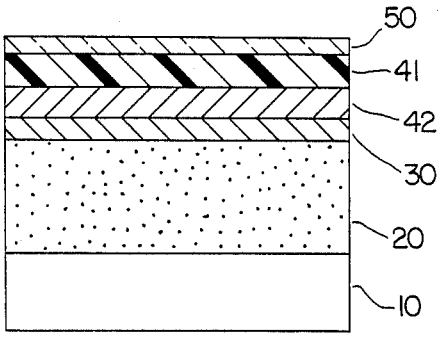
FIG. 2 is a sectional view of the photosensitive body of Example 1.

This photosensitive body has an intermediate layer and a surface protective layer as specified below, and is shown in FIG. 2. The intermediate layer (about 2 μm thick) comprises two layers, each about 1 μm thick, formed by flash deposition. The first layer 41 was formed from an As-Se alloy containing 1.5 weight % As, and the second layer 42 was formed from another As-Se alloy containing weight % As graded from 1.5 to 38.7. The surface protective layer 50 (about 0.5 μm thick) was formed from $Al_2O_3$ by ion plating.

This photosensitive body was produced in the following manner. A fabricated, washed aluminum cylinder (80 mm in diameter) as the substrate was mounted on a support in a vacuum deposition chamber. The chamber was evacuated to a pressure of $1\times10^{-5}$ Torr. With the aluminum cylinder kept at 65° C., an evaporation source containing pure selenium was heated to 300° C. to form the charge transfer layer 20 (about 60 μm thick) by vacuum deposition. The chargeable layer 30 (about 0.5 μm thick) was formed from a Te-Se alloy containing 44 weight % Te by the flash deposition process. The intermediate layer 40 (about 2 μm thick) was formed in two layers 41, 42, each about 1 μm thick, by the flash deposition process. The first layer 41 was formed from an As-Se alloy containing 1.5 weight % As, and the second layer 42 was formed from another As-Se alloy containing As graded from 1.5 to 38.7 weight %. The flash deposition was performed by keeping the support temperature at 60° C., the degree of vacuum at $1\times10^{-5}$ Torr, and the evaporation source at 350° C. Finally, the surface protective layer 50 (about 0.5 μm thick) of $Al_2O_3$ was formed by ion plating on the intermediate layer.

EXAMPLE 2

Figure 3:
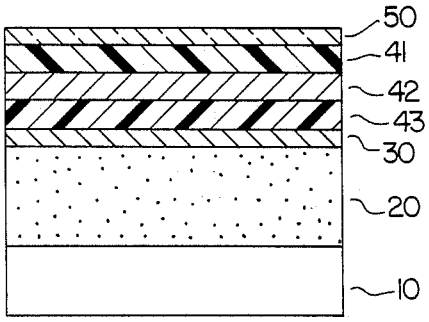
FIG. 3 is a sectional view of the photosensitive body of Example 2.

This photosensitive body, shown in FIG. 3, has an intermediate layer and a surface protective layer specified below. The intermediate layer (about 3 μm thick) is composed of three layers, each about 1 μm thick, formed by the flash deposition process. The first layer 41 was formed from an As-Se alloy containing 1.5 weight % As. The second layer 42 was formed from an As-Se alloy containing a graded concentration of As from 1.5 to 38.7 weight %. The third layer 43 was formed from an As-Se ($As_2Se_3$) alloy containing 38.7 weight % As. The surface protective layer 50 (about 1 μm thick) was formed by coating a mixture of nylon and polyurethane. The other steps were performed in the same manner as in Example 1.

EXAMPLES 3, 4, and 5

Figure 4:
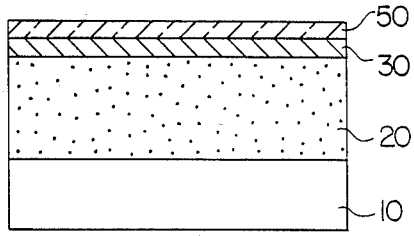
FIG. 4 is a sectional view of the photosensitive body of Examples 3, 4 and 5.

The photosensitive bodies of these three comparative examples are shown generally in FIG. 4 and comprise a charge transfer layer 20, a changeable layer 30, and a surface protective layer 50, but lack an intermediate layer.

The layers 20, 30, and 50 of Example 3 are identical to the corresponding layers of Example 1.

The layers 20, 30, and 50 of Example 4 are identical to the corresponding layers of Example 2.

Example 5 differs from Examples 3 and 4 in that its surface protective layer 50 is identical with the conventional Se-based function separation type photosensitive body for long wavelength light. The surface protective layer (about 3 μm thick) is formed from an As-Se alloy containing 4 weight % As by the flash deposition process. The flash deposition was carried out in the same manner as in Example 1.

The photosensitive bodies prepared in the Examples were examined for electrical properties, abrasion resistance, and heat resistance. The results are shown in Table 1.

TABLE 1

| Photosensitive Body | Electrical properties | Abrasion resistance | Heat resistance | Overall rating |
|---|---|---|---|---|
| Example 1 | Good | Excellent | Good | Excellent |
| Example 2 | Good | Excellent | Good | Excellent |
| Example 3 | Good | Excellent | Poor | Poor |
| Example 4 | Good | Excellent | Poor | Poor |
| Example 5 | Good | Good | Good | Good |

The electrical properties include xerographic characteristics, such as sensitivity, retentivity, and residual potential; and fatigue characteristics, such as charge decay and residual potential rise. As far as the electrical properties are concerned, equally good results were obtained for the first four photosensitive bodies (Examples 1–4) provided with a mechanically superior surface protective layer of $Al_2O_3$ or a mixture of nylon and polyurethane as was obtained for Example 5 (conventional), regardless of the presence or absence of the intermediate layer 40.

The abrasion resistance was rated by measuring the amount of the surface protective layer 50 which was lost after the photosensitive body was run to make 10,000 copies. The photosensitive bodies of Examples 1 and 3, which were provided with the surface protective layer 50 of $Al_2O_3$, was 30 times as durable as the conventional protective layer (Example 5) regardless of the presence or absence of the intermediate layer 40. The photosensitive bodies of Examples 2 and 4, which were provided with the surface protective layer 50 of nylon-polyurethane mixture, was 10 times as durable as the conventional protective layer (Example 5) regardless of the presence or absence of the intermediate layer 40. Thus it was found that the mechanically superior surface protective layer 50 greatly improves the life of the photosensitive body.

The heat resistance was tested by allowing the sample to stand at 40° C. The photosensitive bodies of Examples 3 and 4, which were not provided with the intermediate layer 40, suffered cracking after standing for 50 hours. By contrast, the photosensitive bodies in Examples 1 and 2, which were provided with the intermediate layer 40, did not suffer cracking even after standing for 1000 hours.

Thus it was confirmed that the photosensitive bodies having an intermediate layer as described in Examples 1 and 2 are superior to those lacking such a layer in both abrasion resistance and heat resistance.

We claim:

1. A photosensitive body for electrophotography, comprising in sequence:

a conductive substrate;

a charge transfer layer comprising selenium;

a chargeable layer comprising selenium;

an intermediate layer; and a surface protective layer, wherein the surface protective layer has a coefficient of thermal expansion, different than that of the chargeable layer, and the coefficient of thermal expansion of the intermediate layer changes on a gradient across the section of the intermediate layer from a value substantially equal to that of the chargeable layer at an edge of the intermediate layer adjacent the chargeable layer, to a value substantially equal to that of the surface protective layer at an edge of the intermediate layer adjacent the surface protective layer.

2. The photosensitive body of claim 1, wherein the coefficient of thermal expansion of the surface protective layer is less than that of the chargeable layer.

3. The photosensitive body of claim 2, wherein:

the chargeable layer comprises a tellurium-selenium alloy wherein the tellurium concentration is between 30 and 50 weight %;

the intermediate layer comprises an arsenic-selenium alloy wherein the arsenic concentration increases in a gradient across the section of the layer from an edge adjacent to the chargeable layer to an edge adjacent to the surface protective layer, so as to produce a corresponding decreasing gradient of the value of the coefficient of thermal expansion; and the surface protective layer comprises a material chosen from the group consisting of a selenium alloys, metal oxides and plastics.

4. The photosensitive body of claim 3, wherein the surface protective layer comprises $Al_2O_3$.

5. The photosensitive body of claim 3, wherein the surface protective layer comprises a mixture of nylon and polyurethane.

6. The photosensitive body of claim 3, wherein the surface protective layer comprises a $As_2Se_3$.

7. The photosensitive body of claim 4, wherein the thickness of the chargeable layer is between 0.1 and 1 μm, the thickness of the intermediate layer is between 1 and 5 μm, and the thickness of the surface protective layer is approximately 2 μm.

8. The photosensitive body of claim 5, wherein the thickness of the chargeable layer is between 0.1 and 1 μm, the thickness of the intermediate layer is between 1 and 5 μm, and the thickness of the surface protective layer is approximately 3 μm or less.

9. The photosensitive body of claim 6, wherein the thickness of the chargeable layer is between 0.1 and 1 μm, the thickness of the intermediate layer is between 1 and 5 μm, and the thickness of the surface protective layer is approximately 5 μm.

10. The photosensitive body of claim 3, wherein the arsenic concentration in the intermediate layer increases from 1.5 to 38.7 weight %.

11. The photosensitive body of claim 3, wherein there is disposed between the chargeable layer and the intermediate layer a first intermediate sublayer with a coefficient of thermal expansion substantially equal to that of the chargeable layer.

12. The photosensitive layer of claim 11, wherein the first intermediate sublayer comprises an arsenic-selenium alloy with 1.5 weight % arsenic, and the arsenic concentration in the intermediate layer increases from 1.5 to 38.7 weight %.

13. The photosensitive body of claim 12, wherein the thickness of both the intermediate layer and the first intermediate sublayer are approximately 1 μm.

14. The photosensitive body of claim 11, wherein there is disposed between the intermediate layer and the surface protective layer a second intermediate sublayer with a coefficient of thermal expansion substantially equal to that of the surface protective layer.

15. The photosensitive body of claim 14, wherein the second intermediate sublayer comprises an arsenic-selenium alloy of approximately 38.7 weight % arsenic, and the arsenic concentration in the intermediate layer increases from 1.5 to 38.7 weight %.

16. The photosensitive body of claim 15, wherein the thickness of the first intermediate sublayer, the intermediate layer, and the second intermediate sublayer are each approximately 1 μm.

* * * * *